US006833664B2

(12) United States Patent
Park et al.

(10) Patent No.: US 6,833,664 B2
(45) Date of Patent: Dec. 21, 2004

(54) IMPLOSION PROOF STRUCTURE IN FLAT CATHODE RAY TUBE

(75) Inventors: Sang Yoon Park, Kyongsangbuk-do (KR); In Joo Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 379 days.

(21) Appl. No.: 09/731,733

(22) Filed: Dec. 8, 2000

(65) Prior Publication Data

US 2002/0030433 A1 Mar. 14, 2002

(30) Foreign Application Priority Data

Dec. 10, 1999 (KR) ..... 1999/56497
Jun. 2, 2000 (KR) ..... 2000/30319
Jun. 14, 2000 (KR) ..... 2000/32775

(51) Int. Cl.[7] ..... H01J 29/88

(52) U.S. Cl. ..... 313/479; 313/477 R; 348/821; 348/822; 220/2.1 R; 220/2.1 A

(58) Field of Search ..... 220/2.1 R, 2.2, 220/2.3 R, 2.3 A, 2.1 A; 348/821–824; 313/479, 461, 477

(56) References Cited

U.S. PATENT DOCUMENTS 3,716,661 A * 2/1973 Greeson, Jr. ..... 348/821
4,031,553 A * 6/1977 Sumiyoshi et al. ..... 348/824
4,168,010 A * 9/1979 Dougherty ..... 220/2.1 A
4,207,493 A * 6/1980 Forster ..... 313/477 R
4,858,016 A * 8/1989 Suehiro et al. ..... 348/822
4,884,006 A * 11/1989 Prazak, III ..... 313/116
4,930,015 A * 5/1990 Dougherty et al. ..... 348/822
4,943,862 A * 7/1990 Uesaka et al. ..... 313/477 R
5,127,865 A * 7/1992 Capek et al. ..... 445/30
5,965,974 A * 10/1999 Saito et al. ..... 313/477 R
6,111,352 A * 8/2000 Hanaoka ..... 313/110
6,504,298 B2 * 1/2003 Van Den Brink et al. .. 313/477 R

* cited by examiner

*Primary Examiner*—Edward J. Glick
*Assistant Examiner*—Elizabeth Keaney
(74) *Attorney, Agent, or Firm*—Birch, Stewart, Kolasch & Birch, LLP

(57) ABSTRACT

Implosion proof structure in a flat cathode ray tube having a panel to which the atmospheric pressure is exerted as the flat cathode ray tube is evacuated, including implosion proof means strapped or coated on an outer circumferential surface of a funnel in the vicinity of the panel, thereby enhancing an implosion proof strength of the flat cathode ray tube.

17 Claims, 6 Drawing Sheets a : Direction of band strapping tension
b : Displacement of the rim of panel by band strapping tension
c : Displacement of the central portion of panel by band strapping tension a : Direction of band strapping tension
b : Displacement of the rim of panel by band strapping tension
c : Displacement of the central portion of panel by band strapping tension

IMPLOSION PROOF STRUCTURE IN FLAT CATHODE RAY TUBE

This nonprovisional application claims priority under 35 U.S.C. § 119(a) on Patent Application Nos. P1999-56497 filed in Korea on Dec. 10, 1999, P2000-30319 filed in Korea on Jun. 2, 2000, and P2000-32775 filed in Korea on Jun. 14, 2000, which are herein incorporated by reference.

BACKGROUND OF THE INVENTION

1. Field of the Invention

The present invention relates to a flat cathode ray tube, and more particularly, to an implosion proof structure in a flat cathode ray tube for preventing implosion of the flat cathode ray tube.

2. Background of the Related Art

Referring to FIG. 1, a related art flat cathode ray tube is provided with a planar panel 1, a funnel 3 smoothly curved from a sealing surface to the panel to a neck portion 3*a* having an electron gun sealed therein, welded to the panel 1 with Frit glass, and an electron gun 4 sealed in the neck portion for emitting red, green and blue electron beams toward the panel. In detail, there is a piece 2 of explosion proof glass attached to a front face of the panel for enhancing an explosion proof property of the panel 1, and a fluorescent film 5 on an inside surface of the panel for emitting light as electron beams strike the fluorescent film 5. There is a rectangular rail 6 on an inside surface of the panel, and a shadow mask 7 fitted to the rail 6 in an effective surface of the panel 1 having multiple slits for selecting a color from the electron beams. There is an inner shield 8 fixed at the rear of the rail for protecting the electron beams emitted from the electron gun and travelling toward the panel from geomagnetism, and a deflection yoke 9 on an outer circumferential surface of the neck portion of the funnel for deflecting the electron beams in horizontal and vertical directions. There is a band 11 strapped around the panel 1 for fastening a plurality of lugs 10 to an outer circumference of the panel 1, for use in fastening the foregoing flat cathode ray tube to a sash of a monitor or a TV receiver.

Accordingly, when power is provided to the electron gun 4 sealed in the neck portion 3*a*, to emit thermal electrons, the emitted electrons are accelerated and focused as they pass through a plurality of electrodes in succession, and are directed toward a screen side while being deflected in a vertical and a horizontal direction by the deflection yoke 9. The electron beams emitted from the electron gun 4 and directed toward the screen side are involved in color selection as they pass through fine holes in the shadow mask 7, and strike fluorescent material in the fluorescent film 5. Eventually, a picture is reproduced as the fluorescent material emits lights resulting from an energy difference occurring when electrons in the fluorescent material is first excited and then dropped down to a base state. In order to enhance the electron emission, the cathode ray tube is passed through an evacuation process during its fabrication for keeping an inside of the cathode ray tube under a vacuum in a $10^{-6}$~$10^{-7}$ Torr range.

The evacuation process for the related art flat cathode ray tube will be explained, briefly.

Once the cathode ray tube having the funnel 3 fitted to the flat panel 1 is subjected to the evacuation process, and vacuumed down to a range of $10^{-7}$~$10^{-8}$ Torr, there is a pressure difference between an inside and outside of the cathode ray tube of at least $10^{-6}$ Torr since outside of the cathode ray tube is at a 760 Torr atmospheric pressure. That is, the cathode ray tube is under a pressure of one atmosphere, i.e., $1.01325\times10^5$ N/m$^2$ pressure at all points thereof. Consequently, the panel and the funnel are deformed by the pressure until the outer and inner pressures come to an equilibrium, particularly, the panel 1 collapses in an inward direction of the cathode ray tube in a "c" direction in FIG. 2. Moreover, as a provision for fixing the cathode ray tube that has been subject to the evacuation process to the sash of the monitor or the TV receiver, if the band assembly of the lugs 10 and the band 1 is strapped around the panel 1 under tension, the inward collapse of the panel becomes more serious. That is, as shown in FIG. 2, in the related art implosion proof structure in the cathode ray tube, the strapping of the band 11 around the panel 1 with a tension, having an inward deformation along an axis of the tube of a bulb (the panel plus the funnel) having been through the evacuation process, makes the deformation more serious. Because stress is greater in the vicinity of a sealed surface of the panel 1 and the funnel 3, breakage of the cathode ray tube may occur in the vicinity of the sealed surface due to permanent stresses coming from the one atmosphere pressure difference caused by the evacuation and the strapping force caused by the band around the panel 1. Accordingly, the panel is susceptible to an implosion, in which the cathode ray tube may implode even by a small external impact, and may result in poor picture quality since a front face of the panel is not flat.

For preventing such an implosion of the panel, as an example, the panel in the related art flat cathode ray tube has a thickness at a central portion thereof set greater than a thickness the same region of a cathode ray tube with a conventional radius of curvature. However, the thicker panel causes the following problem.

In the evacuation process of the cathode ray tube during fabrication, the bulb is heated to a temperature in a range of approx. 340~360° C. for extracting gas adsorbed in an inside surface of the bulb. A heat generated at a heater in a furnace heats an outer surface of the bulb by means of convection, and the heat at the outer surface of the bulb is transferred to the inside surface of the bulb by conduction. While glass has a thermal conductivity in a range of approximately 0.92×10−3(W/mm°K), the rail, a metal, has a thermal conductivity in a range of approximately 22.8×10−3(W/mm°K), i.e., the thermal conductivity of glass is relatively lower than metal. As heat conduction is inversely proportional to a thickness of the panel, the bulb may be broken by thermal stress resulting from a temperature difference between an inner surface and an outer surface of the bulb which becomes the greater as the thickness of the flat panel 1 increases. On the other hand, in a Frit sealing process in which the panel 1 and the funnel 3 are sealed with Frit glass carried out before the evacuation, when the Frit glass is crystallized to seal the panel 1 and the funnel 2, the bulb is required to be heated up to approximately 440° C. according to a crystallization characteristic of the Frit glass. Therefore, when the thickness of the panel 1 is great, the bulb may be broken by a temperature difference between the inner surface and the outer surface of the bulb. In order to minimize such breakage, the heating process is required to be prolonged for heating the bulb slowly in an attempt to reduce the temperature difference between the inner surface and the outer surface of the bulb, which deteriorates yield, requires a greater time period for fabrication, and requires an increased amount of heat energy. In a case in which the panel 1 has a thickness equal to, or greater than 18.0 mm, a tint glass application with a light transmittivity of 75% at a thickness of 10.16 mm shows a light transmittivity below 40%, and a dark tint glass application with a light transmittivity of 46% at a thickness of 10.16 mm shows a light transmittivity below 28% (which is actually impossible to apply). Accordingly, there may be a limitation imposed on the design of the bulb in that only a clear glass application with a light transmittivity of 86% at a thickness of 10.16 mm and a semi-clear glass application with a light transmittivity of 82% at a thickness of 10.16 mm are possible. Because the bulb is liable to break when an external impact is applied if the permanent stress caused by the vacuum is excessive, an allowable vacuum stress is restricted to be below 85~120 kgf/cm$^2$ (kilogram-force per square centimeter).

Furthermore, as another example of the related art implosion proof structure, since the flat cathode ray tube has a low implosion proof strength, an implosion proof glass is attached to a front face of the panel by using a resin for absorbing an external impact to the cathode ray tube. However, since a lamination process for attaching the implosion proof glass is required to be carried out in a separate clean room where a state of cleanness is maintained sufficient to prevent occurrence of foreign matter or blow holes, the fabrication process becomes complicated, and increases production costs. Further blow holes occur in the lamination process, defects increase in the cathode ray tube, and productivity is poor.

SUMMARY OF THE INVENTION

Accordingly, the present invention is directed to an implosion proof structure in a flat cathode ray tube that substantially obviates one or more of the problems due to limitations and disadvantages of the related art.

An object of the present invention is to provide an implosion proof structure in a flat cathode ray tube, which can moderate stress in the panel for enhancing an implosion proof strength of the cathode ray tube and preventing implosion of the cathode ray tube.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the implosion proof structure in a flat cathode ray tube having a panel the atmospheric pressure exerts thereto as the flat cathode ray tube is evacuated includes implosion proof means strapped or coated on an outer circumferential surface of a funnel in the vicinity of the panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 3:
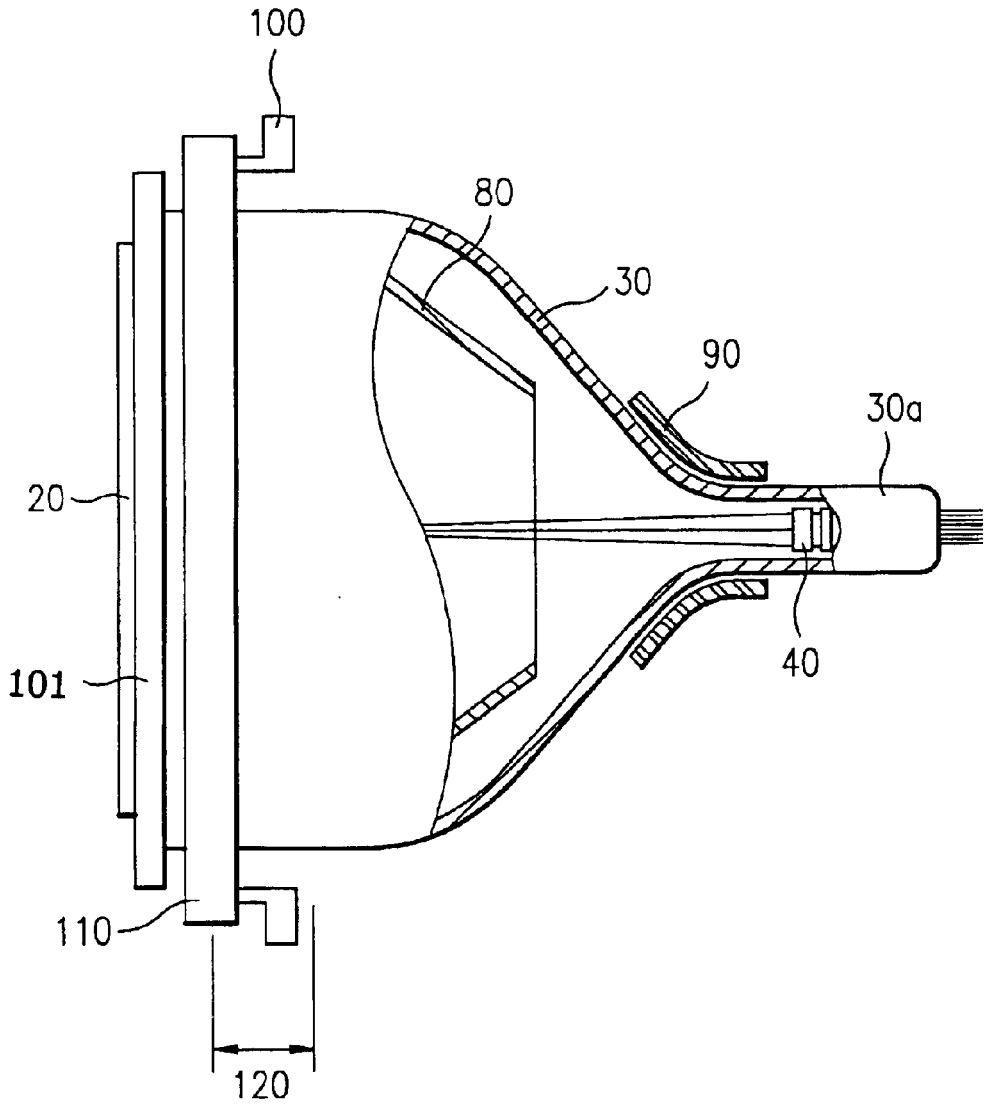
FIG. 3 illustrates a side view with a partial cut away view of a flat cathode ray tube in accordance with a first preferred embodiment of the present invention.

Reference will now be made in detail to the preferred embodiments of the present invention, examples of which are illustrated in the accompanying drawings. FIG. 3 illustrates a side view with a partial cut away view of a flat cathode ray tube in accordance with a first preferred embodiment of the present invention.

Referring to FIG. 3, the implosion proof structure in a flat cathode ray tube in accordance with a first preferred embodiment of the present invention includes a band 110 strapped around a flat portion of a funnel which is perpendicular to the panel for fastening lugs 100 thereto, to fasten the cathode ray tube to a sash of a monitor or TV receiver. In this instance, the band 110 is required to be strapped with a tension in a range of 600 kgf~3000 kgf. If the tension is below 600 kgf, an amount of restoration (from a deformation caused by the evacuation to an original form by the tension of the band) is less than 10%, which is not a substantial improvement of the cathode ray tube deformation. On the other hand, since the improvement of the cathode ray tube deformation brought about when the tension is greater than 3000 kgf is almost the same when the tension is below 3000 kgf, no substantial improvement of the deformation is expected. That is, if the tension of the band 110 is below 600 kgf, an effect of the improvement is not enough in that the improvement is below 10%, while the tension greater than 3000 kgf provides little improvement of the deformation in comparison to a case of tension below 3000 kgf. An outer circumferential surface of the funnel 30 (the band 110 being fastened thereto) is a flat portion 120 perpendicular to the panel 101 larger than a width of the band 110, for preventing the band 110 from slipping away from a proper position, while making strapping stable.

It is preferable that the width of the flat portion 120 of the funnel 30 to which the band 110 is strapped is larger than 16 mm for the following reasons.

Figure 4:
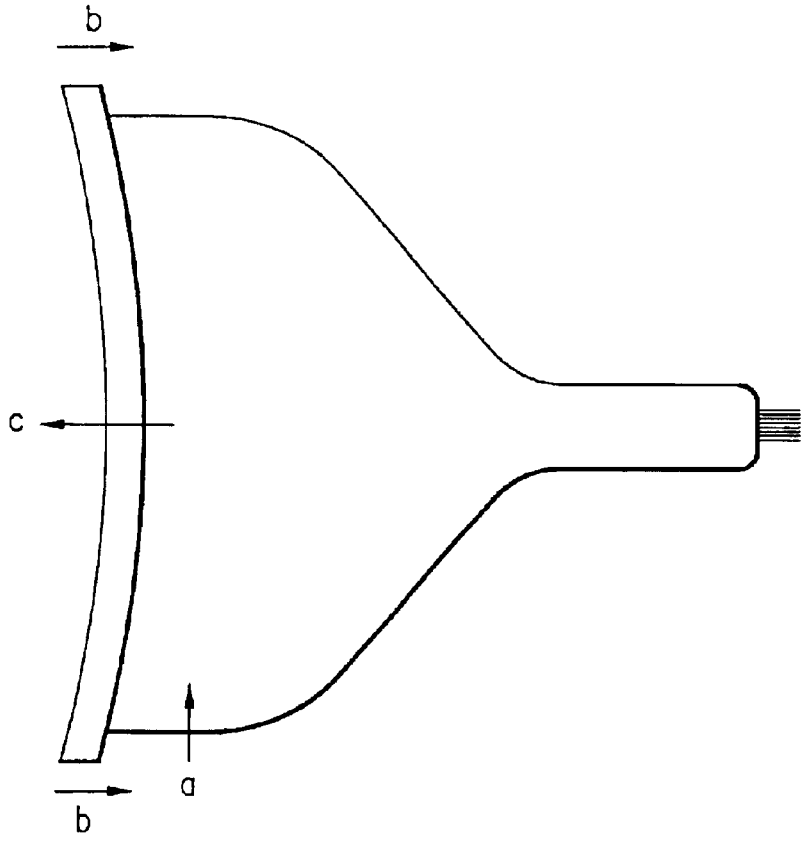
FIG. 4 illustrates deformation of a panel in a flat cathode ray tube in accordance with a first preferred embodiment of the present invention when evacuated, schematically.

As in the case of the related art, if the panel 101 and the funnel 30, sealed together, are subjected to the evacuation process, contraction occurs, in which a central portion of the panel 101 collapses toward an inside of the cathode ray tube. As shown in FIG. 4, when the band 110 is strapped on the flat portion 120, an outer circumferential surface of the funnel 30, in the vicinity of the panel 101 under proper tension, strapping tension of the band is exerted in a direction shown as "a". According to this, a rim of the panel displaces in a direction shown as "b", and the central portion of the panel displaces in a direction shown as "c". Those displacements restore the displacement of the panel 101 caused by the evacuation to a state that is close to an original state. The width of the band 110 versus the strapping tension can be expressed by the equation (1), below.

$$W=T/(t\times\sigma) \quad (1),$$

where, 'W' denotes a width of the band, 't' denotes a thickness of the band, 'T' denotes the strapping tension, and 'σ' denotes a yielding strength of the band. In general, a material used as the band in the cathode ray tube has the yielding strength of approx. 32 kgf/cm$^2$, and 't' in a range of 1.2 mm. Therefore, according to the equation (1), it can be known that the width of the band 110 is required to be at least 16 mm in order to have the strapping tension of the band greater than 600 kgf. According to this, it can also be known that a width of the flat portion 120 of the outer circumferential surface of the funnel formed perpendicular to the panel 101 is required to be at least 16 mm for stable fastening of the band 110 around the outer circumferential surface of the funnel 3.

Figure 5:
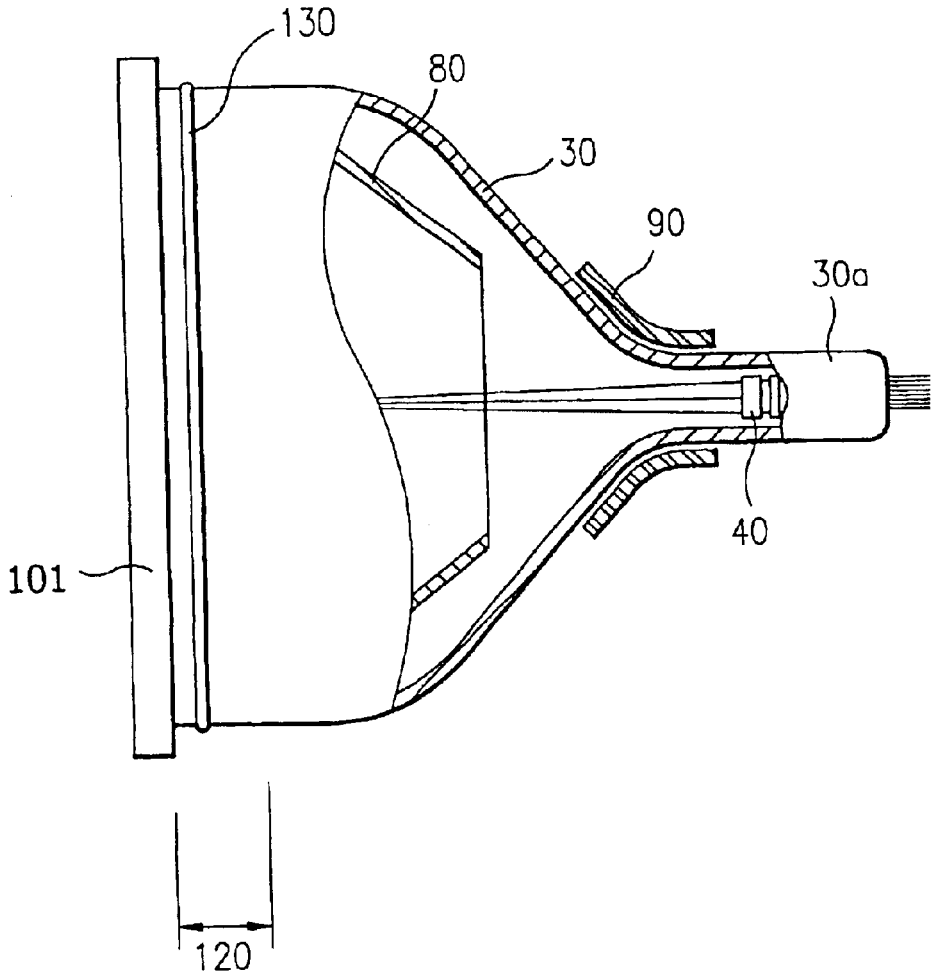
FIG. 5 illustrates a side view with a partial cut away view of a flat cathode ray tube in accordance with a second preferred embodiment of the present invention; and, FIG. 6 illustrates a partial side sectional view of a flat cathode ray tube in accordance with a third preferred embodiment of the present invention, schematically.

FIG. 5 illustrates a side view with a partial cut away view of a flat cathode ray tube in accordance with a second preferred embodiment of the present invention, wherein the band 110 in the first embodiment is replaced with a wire 130 in the second embodiment. Since a strapping tension of the wire 130 is also required to be in a range of 600 kgf~3000 kgf in strapping the wire 130, conditions for the wire 130 can be derived from the equation (1), as follows.

$$W=T/(t\times\sigma) \quad (1),$$

where, 'T' denotes the strapping tension, and 'σ' denotes a yielding strength of the wire 130, and a sectional area of the band W×t may be substituted with $\pi\times R^2$, to express the radius >R= of the wire as an equation (2) below.

$$R=\sqrt{T/(\pi\times\sigma)}$$

where, T denotes the strapping tension, σ denotes a yielding strength of the wire 130, and R is a radius of the wire 130. For example, if a wire 130 of a chrome steel with a yield strength 41.8 kgf/mm$^2$ is used, a required radius of the wire 130 is 2.5 mm or greater from the equation (2), when the strapping tension is greater than 600 kgf.

A deformation behaviour of the flat cathode ray tube with the aforementioned implosion proof structure in accordance with a second preferred embodiment of the present invention will be explained.

Figure 1:
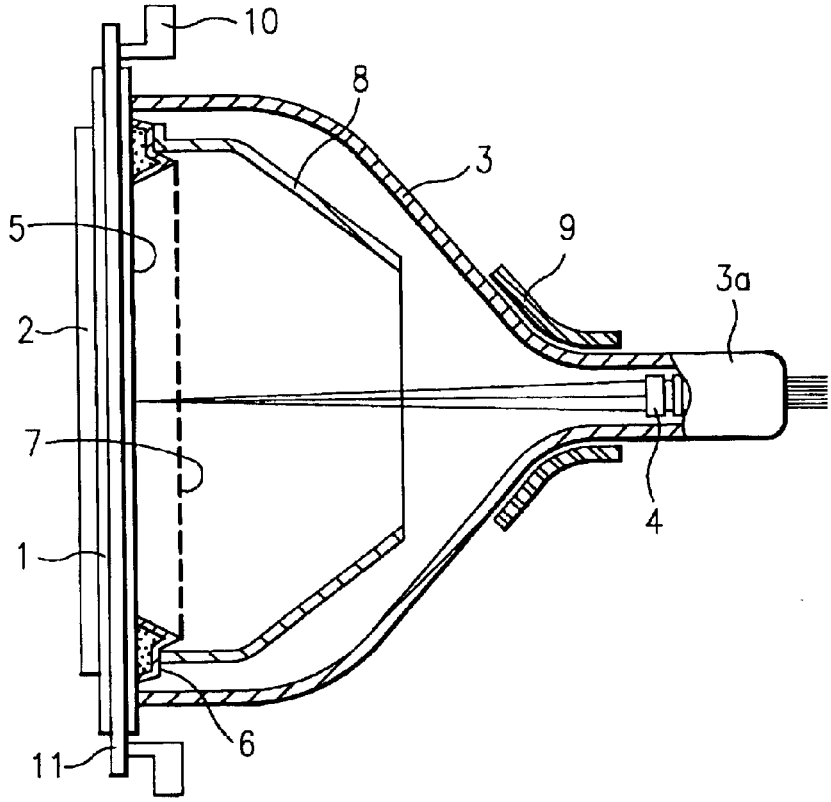
FIG. 1 Related Art
FIG. 1 illustrates a longitudinal section of a related art flat cathode ray tube.
Figure 2:
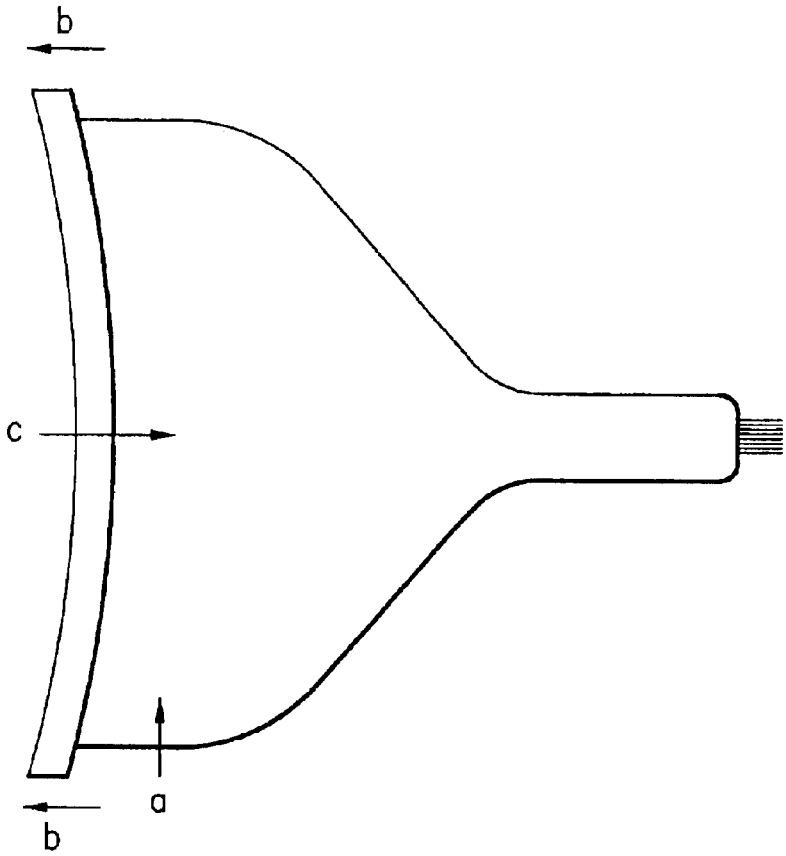
FIG. 2 Related Art
FIG. 2 illustrates deformation of a panel in a related art flat cathode ray tube when evacuated, schematically.

In the evacuation process after the funnel is welded to the panel, and the electron gun is sealed in the funnel, as shown in FIG. 2, the cathode ray tube is involved in collapse of the central portion of the panel toward an inside of the cathode ray tube, and the rim extended outward. In this instance, when the band and the wire 130 have the same sectional areas, the wire 130 has a contact area smaller than the band, to require a smaller width of the flat portion than the band. As shown in FIG. 4, when the band or wire 130 is strapped around the outer circumferential surface 120 of the funnel in the vicinity of a welded region of the panel and the funnel of the foregoing flat cathode ray tube with a tension, the strapping tension is applied in an "a" direction, so that the rim of the panel displaces in the "b" direction, and the central portion of the panel displaces in a "c" direction, offsetting the deformation caused by the evacuation, and restoring the cathode ray tube to a form close to a form before the evacuation. Since the offsetting of the deformation reduces the permanent stress in the flat cathode ray tube, the flat cathode ray tube is made to have an anti-implosion strength which can withstand an external impact.

Figure 6:
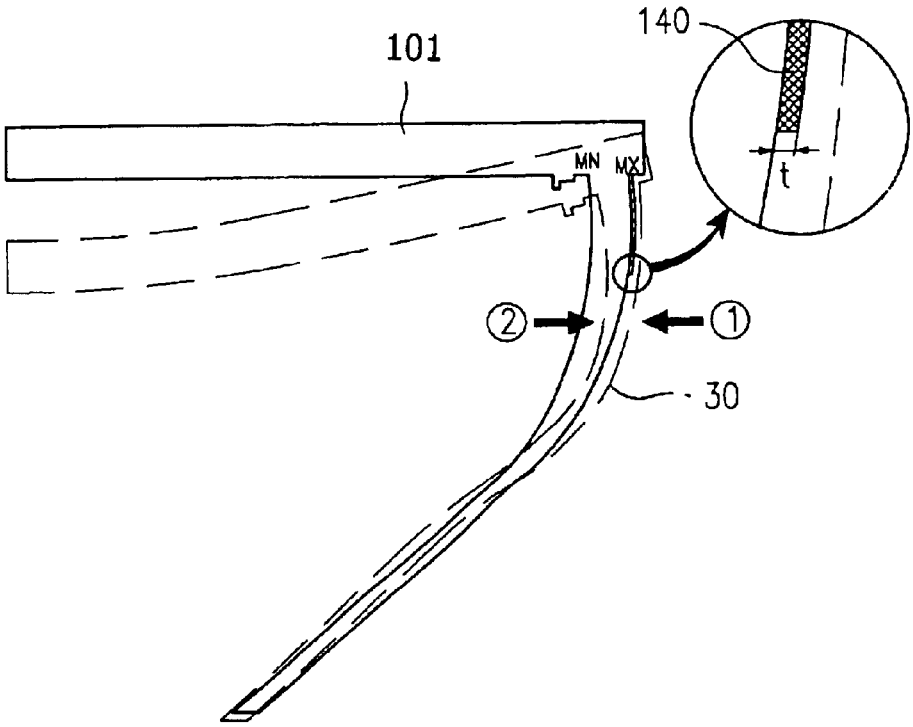

FIG. 6 illustrates a partial side sectional view of a flat cathode ray tube in accordance with a third preferred embodiment of the present invention schematically, wherein a hardening adhesive 140 is applied to an outer circumferential surface of a front portion of the funnel in the vicinity of a welded region of the panel 101 and the funnel 30. The hardening adhesive 140 is of a material hardened by oxygen, heat, or water to have a certain tensile strength (such as a ceramic adhesive). In the evacuation, the deformation (and a consequential tensile stress) occurs at the welded region of the panel and the funnel mostly, i.e., a force ② applied to the funnel from the atmospheric pressure causes a maximum vacuum stress at the welded region in a short axis direction of the panel and the funnel, which in turn causes a deformation of the cathode ray tube as shown in dashed lines in FIG. 6. However, the hardening adhesive 140 coated on the outer circumferential surface of the funnel forms a force ① opposing the force ② from the atmospheric pressure which exerts in a direction the panel collapses toward the inside of the cathode ray tube, and makes a balance against the force ② from the atmospheric pressure, restoring the flat cathode ray tube to form before the evacuation as shown in solid line in FIG. 6, which may be described in detail as follows.

The force from the hardening adhesive 14 to the panel of the cathode ray tube can be defined similar to the equation (1) as shown below.

$$W=Ta/(t\times\sigma) \quad (1),$$

where, Ta denotes the force applied to the cathode ray tube from atmospheric pressure, and, since it is required to apply a strapping tension at least equal to the Ta, the hardening adhesive is required to have a yield strength 'σ', a thickness 't' and a width 'W'. And, the strapping force from the hardening adhesive 140 to the outer circumferential surface of the funnel can be expressed as an equation (3), below.

$$T=p\times R\times W \quad (3),$$

where, 'T' denotes the strapping force from the hardening adhesive 140 to the funnel, 'p' denotes a pressure from a unit area of the hardening adhesive, and R denotes an outer circumference of the funnel, and 'W' denotes a width of the hardening adhesive. Because the force from the hardening adhesive 140 to the outer circumference of the funnel 3 is required to be equal to, or greater than the force from the atmospheric pressure to the panel, for prevention of the deformation of the panel, a relation of the equations (1) and (2) can be expressed as inequalities shown below.

$$T\geqq Ta, \text{ and } p\times R\geqq\sigma\times t \quad (4).$$

That is, since the force Ta from the atmospheric pressure to the cathode ray tube is constant, after the yield strength of the hardening adhesive is fixed, the thickness >t= and the width 'W' are fixed according to equations (1) and (4), i.e., $t\geqq Ta/(\sigma\times W)$, and $W\geqq Ta(p\times R)$. And, in order to make the hardening adhesive to compress the flat cathode ray tube effectively, it is required to set a difference of thermal expansion/contraction coefficients between the hardening adhesive (after hardening) and the funnel to be approx. $5\times10^{-7}$/° C., for maintaining constant compression as the hardening adhesive and the funnel 140 expand/contract in similar ratios when heat is generated by the electron beams upon operation of the flat cathode ray tube. If the hardening adhesive 140 has a small thermal expansion coefficient, the hardening adhesive 140 expands less than the funnel when the flat cathode ray tube is in operation, compressing the funnel excessively, and bulges the panel forward. If the hardening adhesive 140 has a great thermal expansion coefficient, the hardening adhesive 140 expands larger than the funnel, failing to compress the funnel effectively (collapse of the panel is occurs).

As an example of such a coating of hardening adhesive, the width and the thickness of a ceramic adhesive coated on a 17" cathode ray tube will be calculated. In this instance, as the atmospheric pressure is 0.01034 kg/mm$^2$ and the 17" flat cathode ray tube has a panel area of 97900 mm$^2$, the force T from the atmospheric pressure to the front face of the panel is 1012 kgf. As the ceramic adhesive has a yield strength of 25 kg/mm$^2$, and a length of the outer circumference of the funnel is approximately 1260 mm, the thickness 't' of the hardening adhesive 140 is set to be 0.5 mm since $t \geqq Ta/(\sigma \times W)$ according to the equation (1). Then, a pressure per unit area of the funnel from the ceramic adhesive is 0.0099 kg/mm$^2$ according to the equation (4). As the width 'W' of the ceramic adhesive is $W \geqq Ta/(p \times R)$, the width 'W' is greater than 81 mm.

Thus, since the displacements that occurred in the evacuation of the flat cathode ray tube are restored by a strapping force of the band, wire, or the hardening of adhesive on and around the funnel, a thickness of the panel can be reduced substantially as the implosion proof strength of the panel is enhanced. That, in turn, facilitates reducing a temperature difference between the inner and the outer circumferential surface of the panel 101 in the Frit sealing, and evacuation processes when the panel 101 and the funnel 30 are welded. That is, tint glass with a reflectivity of 0.045 and a light absorptivity of 0.04626 or clear glass with a reflectivity of 0.045 (the same as the tint glass) and a light absorptivity of 0.00578, are used. If the panel is formed of tint glass, the panel has a thickness of 18.0 mm and a light transmittivity of 40% or below. Eventually, since the present invention permits reduction of the panel thickness, the limitation on the design of the flat cathode ray tube is reduced in that not only the clear glass, but also tint glass can be used. As the panel has a sufficient implosion proof strength, no implosion proof glass is required. In this instance, it is apparent to a person skilled in this field of art that there may be a variety of applications, such as an application wherein the band is not necessarily used for fastening the lugs, but, a band for fastening the lugs may be strapped around the panel and/or another band may be strapped around the funnel.

As has been explained, the implosion proof structure in a flat cathode ray tube of the present invention can restore a cathode ray tube to an original form, for preventing an implosion of the cathode ray tube, by strapping or coating a band, wire, or hardening adhesive around the funnel to moderate a permanent stress occurring in the cathode ray tube due to a pressure difference between an inside and outside of the cathode ray tube. The enhancement of the implosion proof strength of the cathode ray tube caused by the strapping or coating eases a limitation of the panel design as even a thin panel can meet an allowable vacuum stress. Since no implosion proof glass is required on the front face of the panel, the fabrication process is simplified, productivity is improved, and production costs are reduced.

It will be apparent to those skilled in the art that various modifications and variations can be made in the implosion proof structure in a flat cathode ray tube of the present invention without departing from the spirit or scope of the invention. Thus, it is intended that the present invention cover the modifications and variations of this invention provided they come with the scope of the appended claims and their equivalents.

What is claimed is:

1. An implosion proof structure in a flat cathode ray tube having a panel upon which atmospheric pressure is exerted as the flat cathode ray tube is evacuated, comprising:

implosion proof means strapped around and onto an outer circumferential surface of a funnel in the vicinity of said panel, said implosion proof means being spaced apart from said panel of said flat cathode ray tube.

2. An implosion proof structure as claimed in claim 1, wherein the implosion proof means has a strapping tension in a range of 600–3000 kgf.

3. An implosion proof structure as claimed in claim 2, wherein the implosion proof means is a band with a required yield strength.

4. An implosion proof structure in claim 2, wherein the implosion proof means is a wire with a required yield strength.

5. An implosion proof structure as claimed in claim 4, wherein the wire has a radius greater than 2.5 mm.

6. An implosion proof structure as claimed in claim 1, wherein the outer circumferential surface of the funnel includes a flat portion perpendicular to said panel.

7. An implosion proof structure as claimed in claim 6, wherein the outer circumferential surface of the funnel has a width larger than a width of the implosion proof means, wherein said implosion proof means is a band.

8. An implosion proof structure as claimed in claim 7, wherein a width of the flat portion of the outer circumferential surface of the funnel is set to be equal to, or greater than 16 mm.

9. An implosion proof structure as claimed in claim 1, wherein the implosion proof means is a band with a required yield strength.

10. An implosion proof structure in claim 1, wherein the implosion proof means is a wire with a required yield strength.

11. An implosion proof structure as claimed in claim 10, wherein the wire has a radius greater than 2.5 mm.

12. An implosion proof structure in a flat cathode ray tube having a funnel and a panel upon which atmospheric pressure is exerted as the flat cathode ray tube is evacuated, the funnel having a flat portion in the vicinity of the panel and a curved portion extending from the flat portion, comprising:

implosion proof means coated on an outer circumferential surface of the flat portion of the funnel, excluding the curved portion of the funnel in the vicinity of the panel of said flat cathode ray tube, the implosion proof means being a coat of hardening adhesive with a required yield strength after said adhesive is hardened.

13. An implosion proof structure as claimed in claim 12, wherein the hardening adhesive has a thickness $t \geqq Ta/(\sigma \times W)$.

14. An implosion proof structure as claimed in claim 12, wherein the hardening adhesive has a width $W \geqq Ta/(p \times R)$.

15. An implosion proof structure as claimed in claim 12, wherein the hardening adhesive is formed of a material having a difference in thermal expansion/contraction coefficients between the hardening adhesive after said adhesive is hardened and the funnel to be below approximately $5 \times 10^{-7}$/° C.

16. An implosion proof structure as claimed in claim 12, wherein the hardening adhesive is formed of a ceramic.

17. An implosion proof structure as claimed in claim 16, wherein the ceramic adhesive has a difference in thermal expansion/contraction coefficients between the hardened ceramic adhesive and the funnel to be below approximately $5 \times 10^{-7}$/° C.

* * * * *